US010829973B2

(12) United States Patent
Hazon et al.

(10) Patent No.: US 10,829,973 B2
(45) Date of Patent: Nov. 10, 2020

(54) APPARATUS AND METHOD FOR PULLEY REINFORCEMENT IN A WINDOW REGULATOR

(71) Applicant: INTEVA PRODUCTS FRANCE SAS, Sully sur Loire (FR)

(72) Inventors: Gabriel Hazon, Puzouer-sur-Loire (FR); Stephane Hemond, Les Bordes (FR)

(73) Assignee: INTEVA PRODUCTS FRANCE SAS, Sully sur Loire (FR)

( * ) Notice: Subject to any disclaimer, the term of this patent is extended or adjusted under 35 U.S.C. 154(b) by 8 days.

(21) Appl. No.: 15/275,350

(22) Filed: Sep. 24, 2016

(65) Prior Publication Data

US 2017/0089111 A1 Mar. 30, 2017

(30) Foreign Application Priority Data

Sep. 24, 2015 (FR) ..... 15 59013

(51) Int. Cl.
*E05D 15/16* (2006.01)
*E05F 11/48* (2006.01)
*E05F 15/689* (2015.01)

(52) U.S. Cl.
CPC ..... *E05D 15/165* (2013.01); *E05F 11/483* (2013.01); *E05F 15/689* (2015.01); *E05Y 2201/66* (2013.01); *E05Y 2201/668* (2013.01); *E05Y 2201/684* (2013.01); *E05Y 2600/60* (2013.01); *E05Y 2600/626* (2013.01); *E05Y 2800/682* (2013.01); *E05Y 2900/55* (2013.01)

(58) Field of Classification Search
CPC .... E05D 15/165; E05F 15/689; E05F 15/686; E05F 11/483
See application file for complete search history.

(56) References Cited

U.S. PATENT DOCUMENTS

| | | | | |
|---|---|---|---|---|
| 7,882,658 | B2 | 2/2011 | Staser et al. | |
| 8,631,607 | B2 | 1/2014 | Broadhead et al. | |
| 9,580,953 | B1 * | 2/2017 | Matsushita | E05F 15/689 |
| 9,896,874 | B2 * | 2/2018 | Chono | E05F 15/689 |
| 2007/0289218 | A1 * | 12/2007 | Castellon | E05F 11/483 49/352 |

(Continued)

FOREIGN PATENT DOCUMENTS

| | | | |
|---|---|---|---|
| CN | 101031700 | A | 9/2007 |
| CN | 101730780 | A | 6/2010 |

(Continued)

OTHER PUBLICATIONS

English Abstract for JPH08270314.

(Continued)

*Primary Examiner* — Gregory J Strimbu
(74) *Attorney, Agent, or Firm* — Cantor Colburn LLP

(57) ABSTRACT

A bracket for securing a pulley or deflection ramp to a guide rail of a window regulator. The bracket having: a main body portion; a pulley or ramp support extending away from the main body portion and forming a rotational pulley axis or a ramp attachment; and a flange for transferring loads applied to the pulley or the deflection ramp, wherein the main body portion extends over a top portion of the pulley or deflection ramp and the flange extends away from a distal end of the main body portion.

20 Claims, 5 Drawing Sheets

(56) References Cited

U.S. PATENT DOCUMENTS

| | | | | |
|---|---|---|---|---|
| 2009/0051193 | A1* | 2/2009 | Hernandez | B60J 5/0416 296/146.2 |
| 2009/0188167 | A1* | 7/2009 | Maruyama | E05F 11/483 49/347 |
| 2011/0078957 | A1 | 4/2011 | Deschner | |
| 2015/0191957 | A1* | 7/2015 | Takeda | E05F 11/483 49/352 |

FOREIGN PATENT DOCUMENTS

| | | | |
|---|---|---|---|
| CN | 101801698 | A | 8/2010 |
| CN | 104428478 | A | 3/2015 |
| DE | 202006014697 | U1 | 2/2008 |
| EP | 2952667 | A1 | 12/2015 |
| JP | H0827314 | A | 10/1996 |
| WO | 2006027792 | A1 | 3/2006 |
| WO | 2008112750 | A1 | 9/2008 |

OTHER PUBLICATIONS

English Abstract for WO2008034853 (equivalent to DE20062014697).
French Search Report for Application No. FR1559013.
Written Opinion for Application No. FR1559013.
English Machine Translation to DE20062014697.
CN Office Action for Application No. 201610842912.2; dated May 13, 2019.
English Translation to CN Office Action for Application No. 201610842912.2; dated May 13, 2019.
Search Report for Application No. 201610842912.2.
CN Office Action for Application No. 201610842912.2; dated Mar. 20, 2020.
English Translation to CN Office Action for Application No. 201610842912.2; dated Mar. 20, 2020.
CN Office Action for Application No. 201610842912.2; dated Sep. 8, 2020.
English Translation CN Office Action for Application No. 201610842912.2; dated Sep. 8, 2020.

* cited by examiner

APPARATUS AND METHOD FOR PULLEY REINFORCEMENT IN A WINDOW REGULATOR

CROSS REFERENCE TO RELATED APPLICATIONS

This application claims foreign priority under 35 U.S.C. § 119 to French Patent Application No. 15/59013 filed on Sep. 24, 2015, the entire contents of which are incorporated herein by reference thereto.

BACKGROUND

Various embodiments of the present invention relate to a cable window regulator and more particularly, an apparatus and method for reinforcing the support of a cable deflection means of the window regulator.

In addition, embodiments of the present invention provide improved window regulator systems.

Actuation of windows, such as vehicle windows, often utilizes window regulator systems for controlling vertical movement of the window. In one configuration, the window regulator systems include one or more window attachments carriers or sliders each slidably engaging a guide rail. The window attachment also includes an attachment feature for attachment of the window to the window attachment and hence the window moves as the attachment slides along the guide rail. In order to facilitate the movement of the window, the window attachment is secured to a drive means, such as a cable, which is driven by a drum rotated by a motor or a lever actuated manually. In operation and as the drum rotates, a portion of at least one cable is wound onto the drum while a portion of the at least one cable or another cable is unwound from the drum. Each cable is secured to the window attachment to either pull or allow for (e.g., unwind) slidable movement of the window attachment as the cable drum is rotated by the motor.

Since the cable drum is typically remotely located from the ends of the guide rail the window attachment slides along, pulleys or deflection ramps are located near or at the distal ends of the guide rail so that as the cable drum is rotated the applicable force is applied to the window attachment in order to cause it to slide along the guide rail. The pulleys provide rotational support of the cable(s) as they are wound and unwound from the cable drum. The deflection ramps provide sliding support of the cable(s) as they are wound and unwound from the cable drum. Due to the force applied to the pulleys or ramps via the cable it is necessary to ensure that the cable pulley or ramp and the guide rail it is secured to is designed to withstand the forces applied thereto via the cable.

Accordingly, it is desirable to provide an apparatus and method for reinforcing a pulley support of the window regulator.

SUMMARY OF THE INVENTION

In one embodiment, a bracket for securing a pulley or deflection ramp to a guide rail of a window regulator is provided. The bracket having: a main body portion; a pulley or ramp support extending away from the main body portion and forming a rotational pulley axis or a ramp attachment; and a load diffusing means for transferring loads applied to the pulley or the deflection ramp, wherein the main body portion extends over a top portion of the pulley or deflection ramp and a flange of the load diffusing means extends away from a distal end of the main body portion.

In addition to one or more of the features described above, or as an alternative to any of the foregoing embodiments, the bracket may be formed from steel, aluminum or plastic.

In addition to one or more of the features described above, or as an alternative to any of the foregoing embodiments, further embodiments include an opening that may be located in the main body portion between a pair of collars.

In addition to one or more of the features described above, or as an alternative to any of the foregoing embodiments, the pulley support may be a collar that is configured to rotationally receive the pulley and the load diffusing means further comprises a collar located between the flange and the collar.

In addition to one or more of the features described above, or as an alternative to any of the foregoing embodiments, the flange may have a curved surface configured to disperse an axial load upon a surface of the guide rail.

In addition to one or more of the features described above, or as an alternative to any of the foregoing embodiments, the guide rail may be formed from plastic.

In addition to one or more of the features described above, or as an alternative to any of the foregoing embodiments, the guide rail may be formed from plastic or a plastic composite and the bracket is formed from steel, aluminum or plastic and wherein the guide rail has a pair of integrally formed bosses configured to be received within the pair of collars when the bracket is secured to the guide rail.

In addition to one or more of the features described above, or as an alternative to any of the foregoing embodiments, the pulley or deflection ramp may be an upper pulley or upper deflection ramp.

In addition to one or more of the features described above, or as an alternative to any of the foregoing embodiments, further embodiment include a window regulator having the bracket with one or more features described above and the window regulator has: a guide rail; at least one pulley or deflection ramp for guiding a cable of the window regulator, wherein the bracket secures the at least one pulley or deflection ramp to the guide rail and wherein loads transferred by the bracket are transferred to a portion of the guide rail remote from the pulley or deflection ramp.

In addition to one or more of the features described above, or as an alternative to any of the foregoing embodiments, the bracket may be formed from steel, aluminum or plastic.

In addition to one or more of the features described above, or as an alternative to any of the foregoing embodiments, further embodiments include an opening that may be is located in the main body portion between a pair of collars.

In addition to one or more of the features described above, or as an alternative to any of the foregoing embodiments, the pulley support may be a collar configured to rotationally receive the pulley and the load diffusing means further comprises a collar located between the flange and the collar.

In addition to one or more of the features described above, or as an alternative to any of the foregoing embodiments, the flange may have a curved surface configured to disperse an axial load upon a curved surface of the guide rail.

In addition to one or more of the features described above, or as an alternative to any of the foregoing embodiments, the guide rail may be formed from plastic or a plastic composite.

In addition to one or more of the features described above, or as an alternative to any of the foregoing embodiments, the guide rail may be formed from plastic or a plastic composite and the bracket is formed from steel, aluminum or plastic and wherein the guide rail has a pair of integrally formed bosses configured to be received within the pair of collars when the bracket is secured to the guide rail.

In addition to one or more of the features described above, or as an alternative to any of the foregoing embodiments, the bracket may be secured to the rail by a fastener that passes through an opening in the bracket.

In addition to one or more of the features described above, or as an alternative to any of the foregoing embodiments, further embodiments may include an opening that may be located between the pair of collars of the bracket.

In addition to one or more of the features described above, or as an alternative to any of the foregoing embodiments, the pulley or deflection ramp may be an upper pulley or upper deflection ramp.

In yet another embodiment, a method of transferring axial loads of a pulley of a window regulator to a surface of a guide rail of the regulator is provided. The method including the steps of: rotatably securing the pulley to a first collar of a bracket; securing the bracket to the guide rail, wherein the first collar is located about a first boss of the guide rail; and transferring axial loads applied to the first collar to a flange of the bracket, wherein the flange is secured to the first collar via a main body portion that extends over a top portion of the pulley.

In addition to one or more of the features described above, or as an alternative to any of the foregoing embodiments, the bracket may be formed from steel, aluminum or plastic and the guide rail and the first boss may be formed from plastic or a plastic composite.

In addition to one or more of the features described above, or as an alternative to any of the foregoing embodiments, the bracket may have a second collar configured to be located over a second boss when the bracket is secured to the guide rail.

In addition to one or more of the features described above, or as an alternative to any of the foregoing embodiments, the flange may have a curved surface configured to align with a curved surface of the guide rail when the bracket is secured to the guide rail.

In addition to one or more of the features described above, or as an alternative to any of the foregoing embodiments, the flange may have a generally flat surface configured to disperse an axial load upon a generally flat surface of the guide rail.

In addition to one or more of the features described above, or as an alternative to any of the foregoing embodiments, the pulley or deflection ramp may be an upper pulley or upper deflection ramp.

In addition to one or more of the features described above, or as an alternative to any of the foregoing embodiments, the flange may have a generally flat surface configured to disperse an axial load upon a generally flat surface of the guide rail.

BRIEF DESCRIPTION OF THE DRAWINGS

These and/or other features, aspects, and advantages of the present invention will become better understood when the following detailed description is read with reference to the accompanying drawings in which like characters represent like parts throughout the drawings, wherein.

Figure 1:
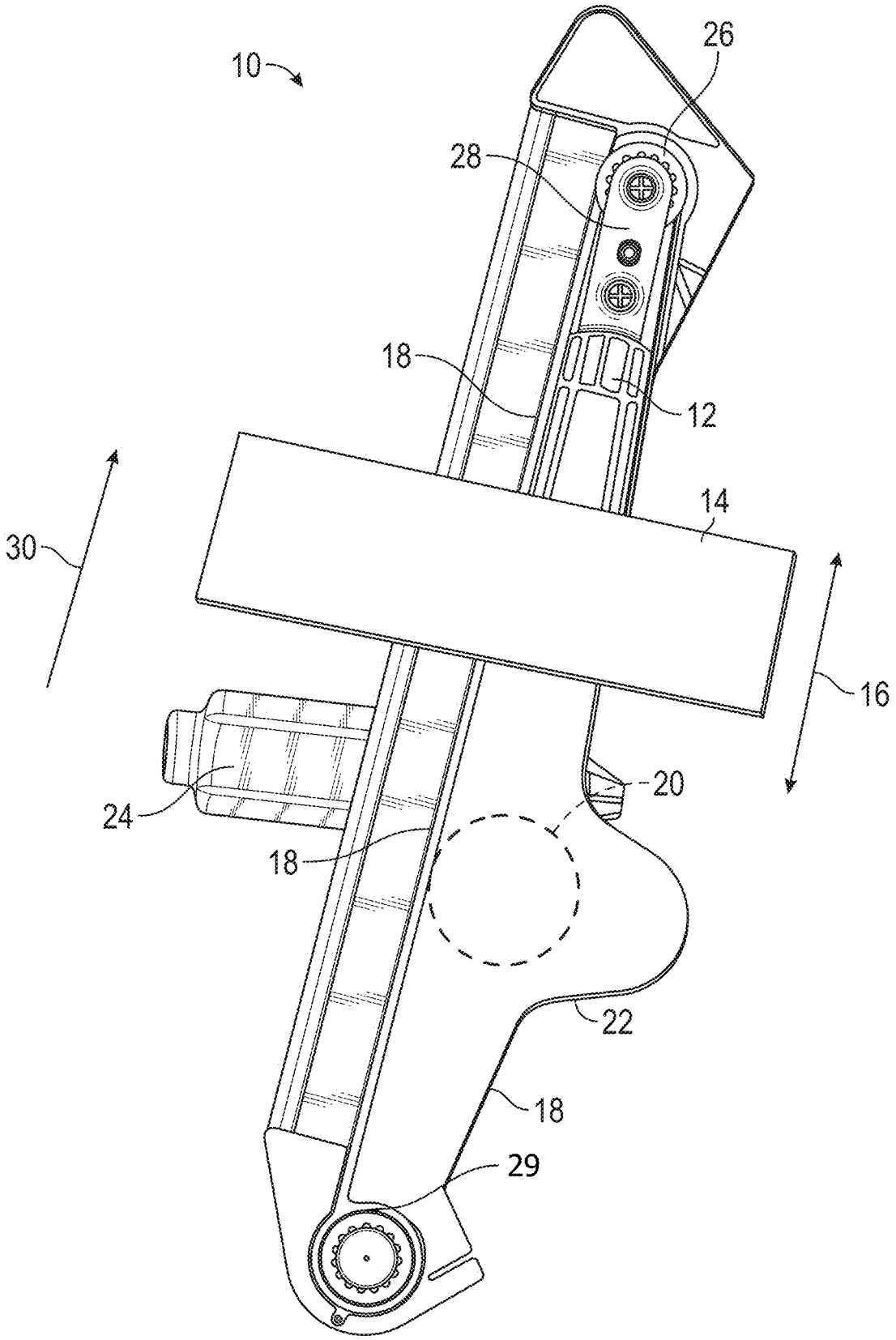
FIG. 1 is a perspective view of a window regulator in accordance with an embodiment of the present invention.

Although the drawings represent varied embodiments and features of the present invention, the drawings are not necessarily to scale and certain features may be exaggerated in order to illustrate and explain exemplary embodiments of the present invention. The exemplification set forth herein illustrates several aspects of the invention, in one form, and such exemplification is not to be construed as limiting the scope of the invention in any manner.

DETAILED DESCRIPTION

Referring now to the FIGS., a window regulator 10 is illustrated. Window regulator 10 has a guide rail 12 and a window attachment, carrier or slider 14 slidably secured to the guide rail for movement in the direction of arrows 16 is response to movement of a cable or pair of cables 18 each having one end operatively coupled to the carrier 14 at one end and a cable drum 20 (illustrated by the dashed lines in FIG. 1). The cable drum 20 is rotationally received within a housing 22 and is operatively coupled to a motor 24 such that as the motor is energized the cable drum 20 will rotate and one cable 18 will be wound onto the cable drum 20 while the other cable 18 is unwound from the cable drum 20 in order to provide the desired movement of the carrier in the directions of arrows 16.

Figure 2:
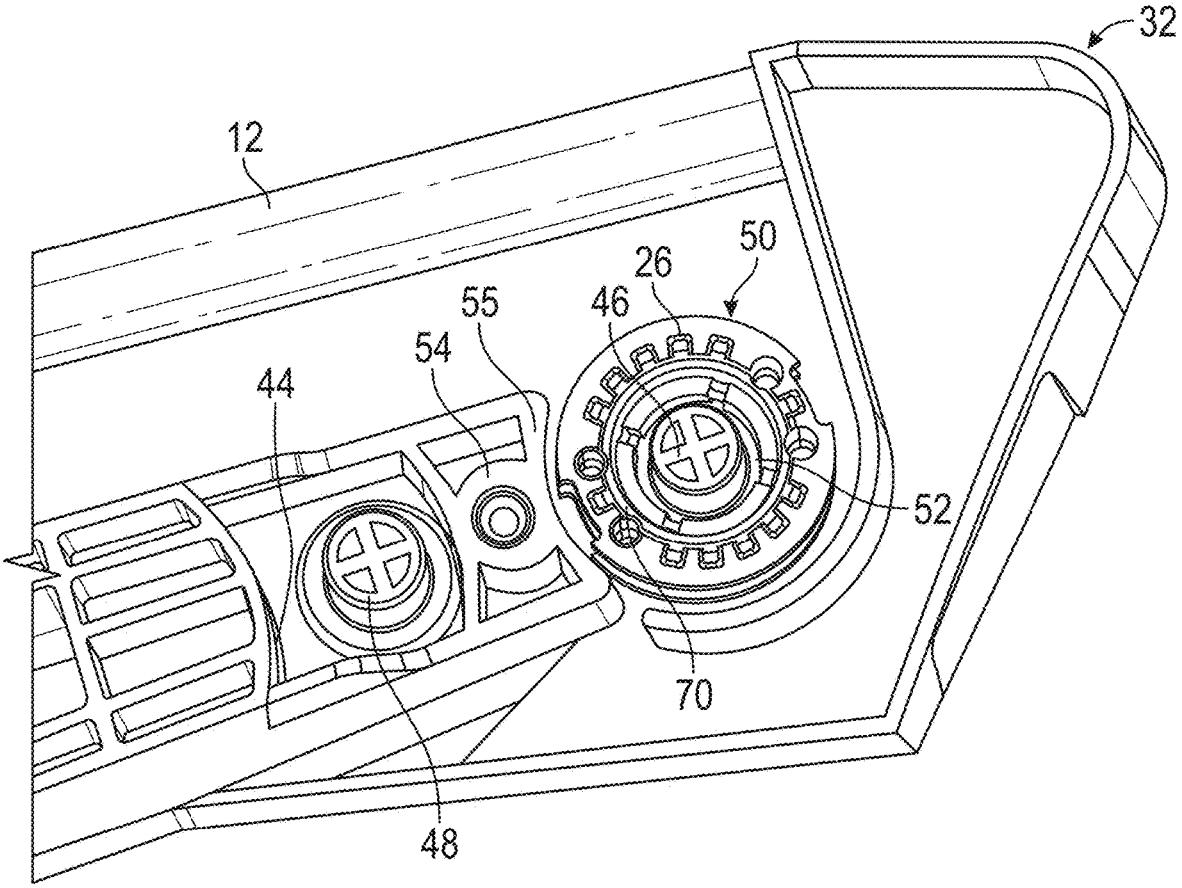
FIG. 2 is a view of a partially assembled upper portion of the guide rail of the window regulator.
Figure 3:
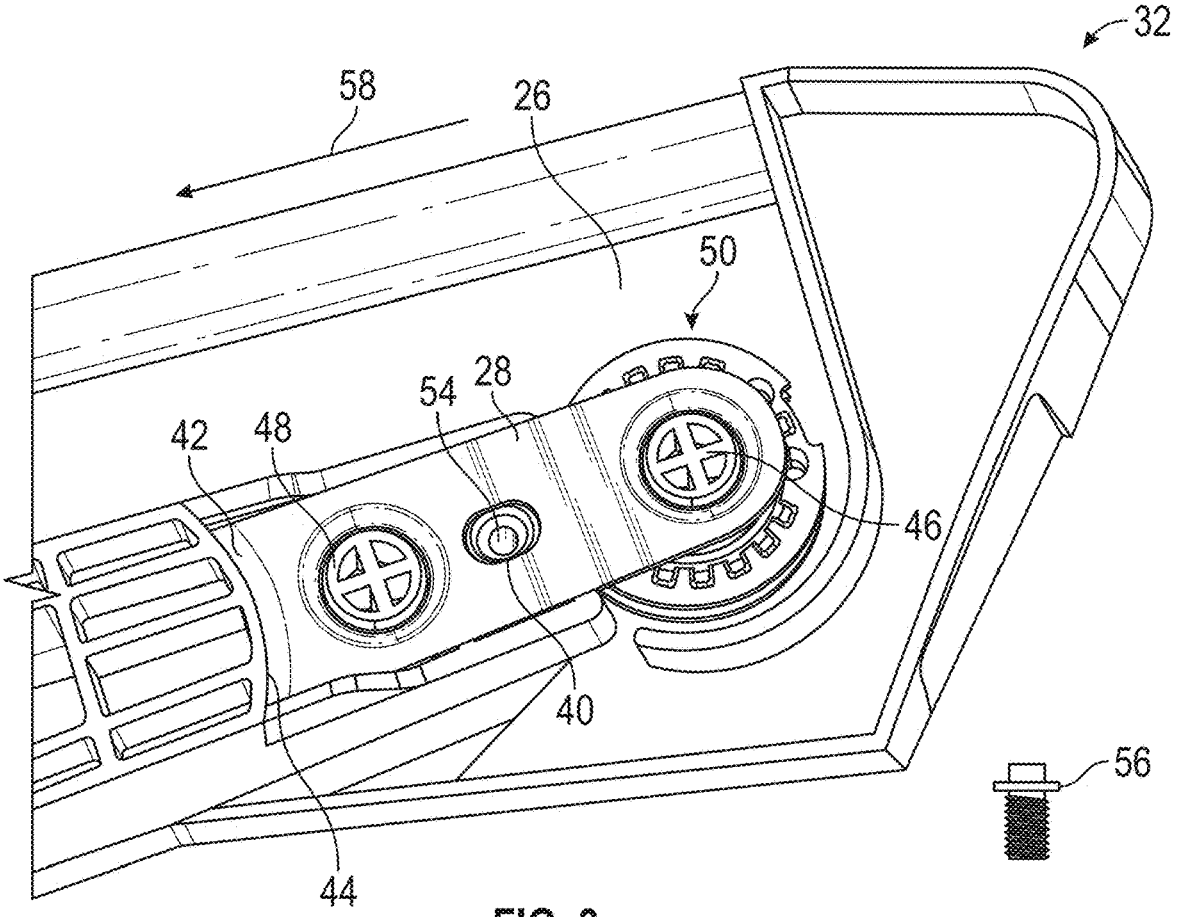
FIG. 3 is a view of an assembled upper portion of the guide rail of the window regulator.
Figure 4:
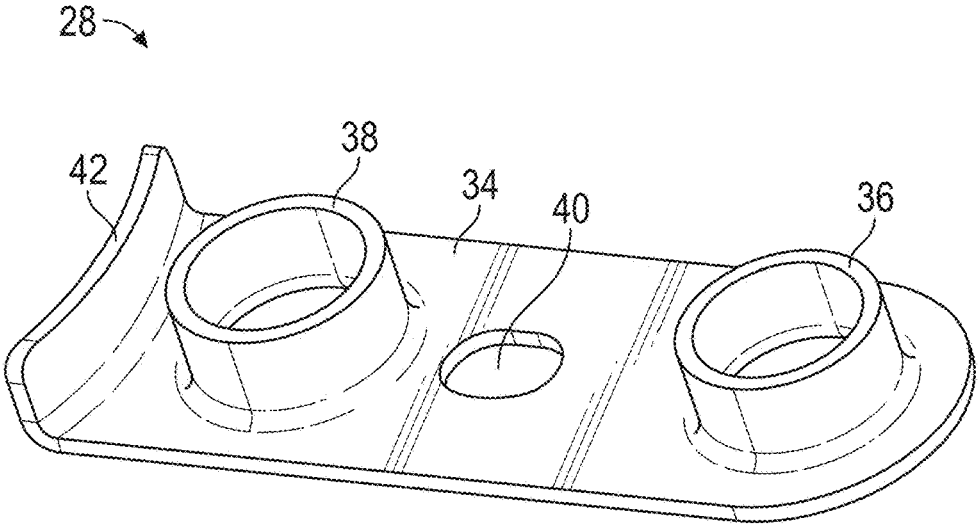
FIG. 4 is a perspective view of a bracket in accordance with an embodiment of the present invention.
Figure 5:
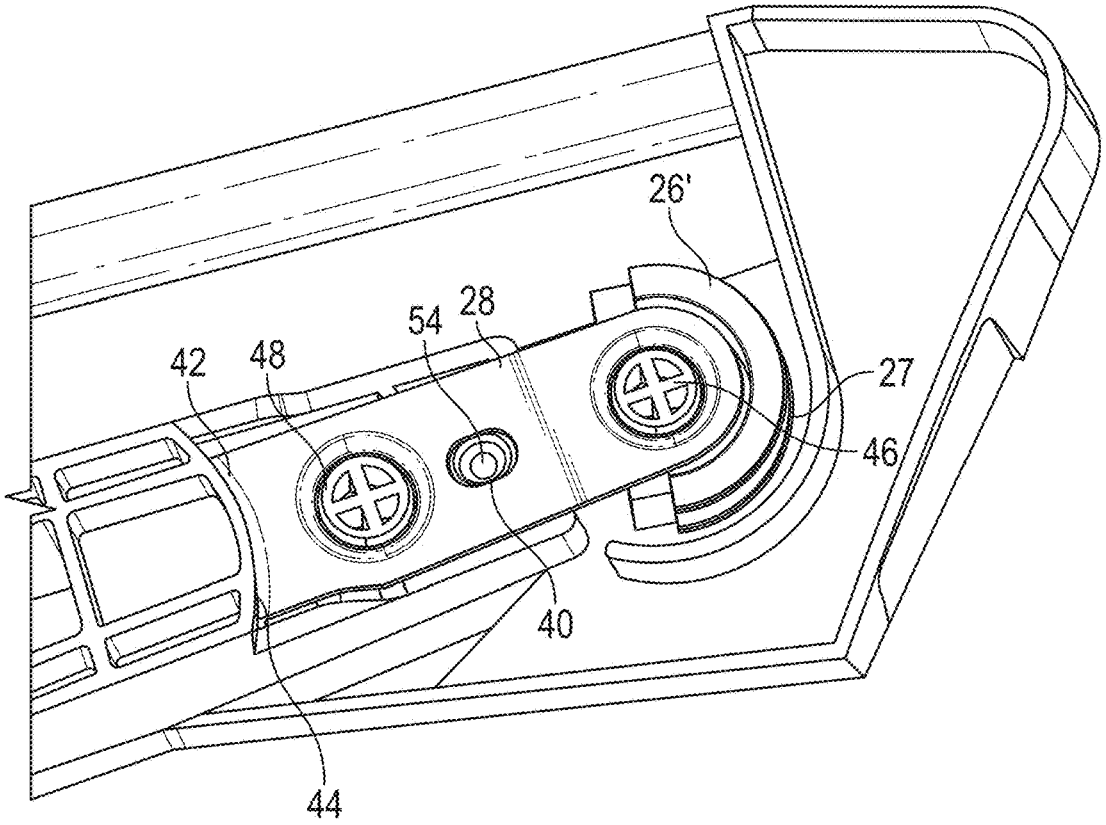
FIG. 5 a perspective view of an alternative embodiment of the present invention is illustrated.
Figure 6:
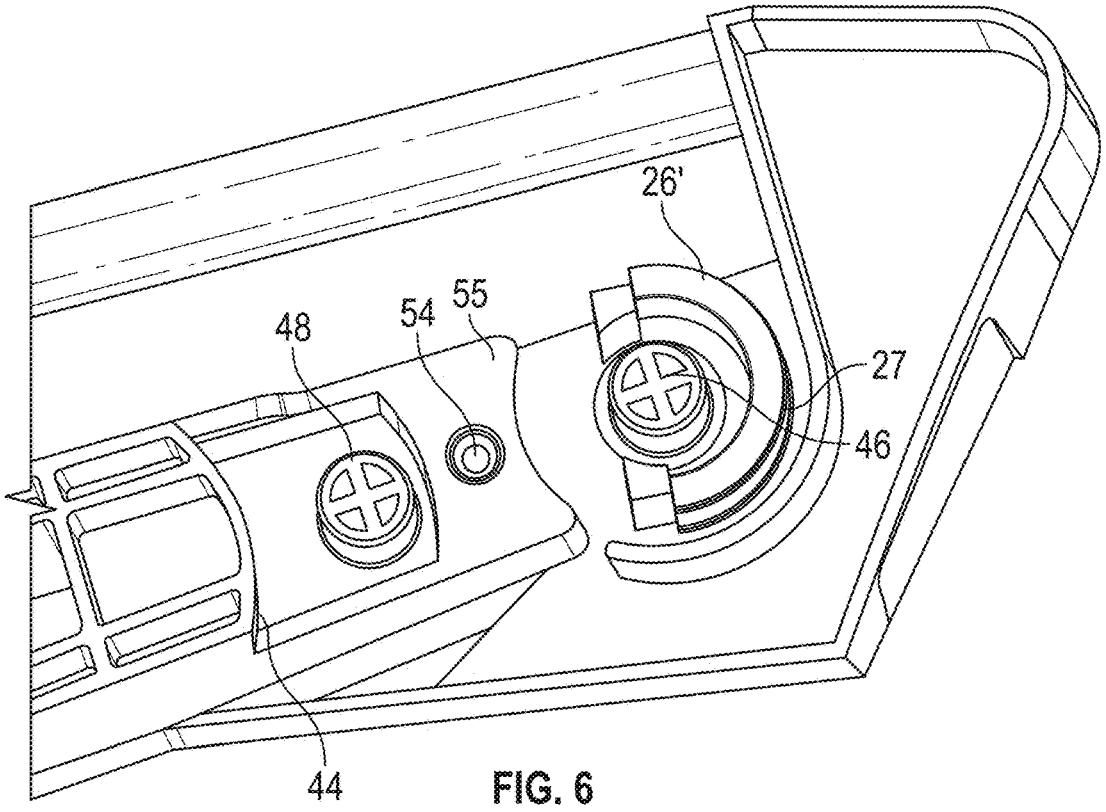
FIG. 6 a perspective view of the embodiment of FIG. 5 with the bracket removed.

In order to transfer the rotational movement of the cable drum 18 to the carrier 14, pulleys 26 are rotationally secured to the guide rail 12. FIGS. 1-3 illustrate potential locations of the pulley(s) 26 securement to guide rail 12. At least one of the pulleys 26 is mounted to the guide rail 12 via a mounting or reinforcement bracket 28, which is illustrated in FIGS. 3 and 4. In one embodiment, the mounting or reinforcement bracket 28 is used with an upper pulley 26 or upper deflection ramp or upper cable ramp 26' as opposed to a lower pulley 29 or lower deflection ramp or cable ramp. In one, embodiment the configuration of the lower pulley 29 or lower deflection ramp or lower cable ramp may be different than the upper pulley or upper deflection ramp or upper cable ramp or in yet another embodiment, they may be the same. As used herein the upper pulley 26 is located at the top of FIG. 1 and is subjected to the largest loads when a window secured to the carrier 14 is moved upwardly in the direction of arrow 30. Of course, bracket 28 may be used in any location for securing pulley 26 to the guide rail 12. As will be described herein the bracket 28 provides a load diffusing means for loads axial or otherwise that are applied to pulley 26 or alternatively a cable ramp or defection ramp 26' (illustrated in FIGS. 5 and 6) and as mentioned above may be an upper cable ramp or upper deflection ramp 26'. In the embodiment of FIGS. 5 and 6, the deflection ramp 26' may be a curved or semi-circular configuration that is fixedly secured to guide rail 12 and the cable 18 slides along in a groove or trough 27 of the deflection ramp 26'. For example and in one embodiment, deflection ramp 26' may be integrally formed with the guide rail 12 such that deflection ramp 26' is formed from the same material for example the plastic or plastic composite of the guide rail 12. In another embodiment, the deflection ramp 26' may be insert molded into the guide rail 12 wherein deflection ramp 26' may be formed from a more rigid plastic material or metal and is integrally formed with the guide rail 12. It is, of course, understood that defection ramp 26' may have curved configurations greater or less than those illustrated in the attached FIGS. as long as the deflection ramp 26' is of a sufficient size to guide cable 18.

In accordance with one embodiment of the present invention, the guide rail 12 is formed from a plastic or plastic composite or composite guide rail 12. The plastic or plastic composite or composite guide rail 12 allows for ease of manufacture, reduced weight and other advantages. In motor vehicle applications, reducing the weight of components and thus the overall weight of the vehicle is desired. However, such light weight components must still be configured to withstand operational loads in different thermal and environmental conditions. Thus, it is desirable to reinforce the pulley's or the ramp's securement to the guide rail. Reinforcement of the pulley 26 or the deflection ramp or cable ramp 26' will counteract potential deformation issues that may occur in plastic and/or composite guide rails 12 especially when the pulley is under high loads and the system or regulator 10 is subjected to high temperatures. Although it is contemplated to use the reinforcement bracket 28 with plastic and/or composite guide rails 12 it is, of course, understood that various embodiments of the present invention may be used in conjunction with guide rails formed from other materials such as metal, alloys, etc.

FIG. 2 illustrates an upper portion 32 of the guide rail 12 without reinforcement bracket 28 while FIG. 3 illustrates the upper portion 32 of the guide rail 12 with the pulley 26 secured thereto by reinforcement bracket 28. Similar views of the alternative embodiment (ramp 26') are shown in FIGS. 5 and 6. FIG. 4 is a perspective bottom view of the reinforcement bracket 28. As illustrated, the reinforcement bracket 28 has a main body portion 34. Extending away from main body portion 34 is a pair of collars or a first support collar 36 and a second support collar 38. Alternatively, the reinforcement bracket 28 may be constructed with a single support collar either collar 36 or collar 38. A securement opening 40 is located in main body portion 34. In one embodiment, the securement opening 40 is located between the first support collar 36 and the second support collar 38. The reinforcement bracket 28 has a flange or flange portion 42 also extending away from a distal end of the main body portion 34. In one embodiment, the flange portion 42 is curved to coincide with a complimentary curved surface 44 of the guide rail 12, when the reinforcement bracket 28 is secured to the upper portion 32 of the guide rail 12. In an alternative embodiment, surfaces 42 and 44 may have alternative configurations such as flat or planar surfaces. In one embodiment, the reinforcement bracket 28 may be formed out of steel of a steel alloy. Alternatively, the bracket 28 may be formed from aluminum or an aluminum alloy. In yet another alternative, the bracket 28 may be formed from plastic or plastic composite. Of course, other suitable materials are contemplated for use with reinforcement bracket 28.

In one embodiment, the first support collar 36, the second support collar 38 and the flange portion 42 may be integrally formed with the reinforcement bracket 28. When the reinforcement bracket 28 is secured to the upper portion 32 of the guide rail 12 the first support collar 36 is located over a first boss 46 of the upper portion 32 of the guide rail 12 and the second support collar 38 is located over a second boss 48 of the upper portion 32 of the guide rail 12. In addition and when the reinforcement bracket 28 is secured to the upper portion 32 of the guide rail 12, the main body portion 34 extends over and from a top portion of the pulley 26 towards the surface 44.

As illustrated in FIG. 2, the pulley 26 is rotatably received in an area or receiving area 50 of the upper portion 32 of the guide rail 12. When installed into the area or receiving area 50 an inner opening 52 of the pulley 26 is located about first boss 46. The inner opening 52 has a diameter that is larger than an outer diameter of the first boss 46 such that a gap is provided when the pulley 26 is placed in area 50. This gap will allow the reinforcement bracket 28 to be secured to the upper portion 32 of the guide rail 12 when the pulley 26 is in area 50.

When the reinforcement bracket 28 is secured to the upper portion 32 of the guide rail 12, the first support collar 36 is located between the inner opening 52 and the first boss 46. In addition, a portion of the main body portion 34 extends over a top portion 70 of the pulley 26. As used herein, top portion 70 refers to the side surface of the pulley 26 that is furthest from the surface of the guide rail 12 that first boss 46 extends from. In addition, the second support collar 38 is located over the second boss 48 and the flange 42 is adjacent to the surface 44 when the bracket 28 is secured to the guide rail 12. The opening 40 is also aligned with an opening 54 in the guide rail 12 when the bracket 28 is placed over first boss 46 and second boss 48 such that a fastener or screw 56 can be inserted into openings 40 and 54 and secure the reinforcement bracket 28 to the guide rail 12. In one embodiment, the fastener or screw 56 engages threads in opening 54 or in yet another embodiment, the fastener or screw 56 may be a self-tapping screw configured to engage a non-threaded opening 54. Of course, numerous means for securing bracket 28 to guide rail 12 may be used in accordance with various embodiments of the present invention. In one embodiment, opening 54 may be located in an elevated feature 55 of the guide rail 12 in order to locate opening 54 proximate to opening 40.

Once the bracket 28 is secured to the guide rail 12, the first collar 36 provides a rotational axis for the pulley 26, and the second collar 38 and the flange 42 extends parallel to the first collar 36 or rotational axis of the pulley 26. This configuration allows axial loads in the direction of arrow 58 to be also transferred or supported by surface 44 and 48 via flange 42 and collar 38 and thus no high axial loads in the direction of arrow 58 are applied to boss 46.

Accordingly, at least one collar of the bracket 28 provides a rotational axis for the pulley 26 and the bracket 28 transfers the load coming from cable 18 to the surface 44 of the guide 12 via flange 42. In addition and in one embodiment, the load that supports the first collar 36 is diffused on several rail surfaces in order to minimize stress and strain on rail.

The inner hole of each collar of the bracket 28 is centered about a plastic/composite boss 46, 48 coming from the rail 12. These bosses offer first surfaces, which allow the load coming from the cable 18 of the system to be diffused. In addition, the flange 42 of the bracket 28 is applied on a rail surface 44 and is properly oriented to diffuse the cable load on this rail surface. Still further and as mentioned above, a portion of the main body portion 34 extends over the top portion 70 of the pulley 26.

In addition and as described above holes 40 and 54 allow the bracket 28 to be screwed into the plastic/composite rail 12. The screw 56 maintains the bracket to rail 12 in a Y direction (wherein the Y direction is the direction of the pulley axis). Moreover, the various embodiments of the invention described herein allows the pulley area to be reinforced against creep issue by transforming a compression constrain to a compression one on a larger surface. In other words, axial loading in the direction of arrow 58 is transferred to the larger surface 44, 46 and 48.

Although, the reinforcement bracket 28 is illustrated with two collars it is understood that alternative embodiments of the present invention may include a bracket 28 with only a single collar and boss or more than two collars and two bosses. Still further and in yet another embodiment, the bracket 28 may be secured to the guide rail 12 by any suitable means for example, the bracket may be "snap fitted" into the guide rail 12, wherein features of the bracket 28 engage complementary features of the guide rail 12 thereby negating the need for screw 56 and/or openings 40 and 54. Still further and in yet another embodiment, the screw 56 and openings 40 and 54 may be used in combination with a "snap fittingly" engaged bracket 28. Still further, the securing means to the guide 12 may be designed for also diffusing loads in direction of arrow 58

Through the use of bracket 28, a simple thermoplastic rail 12 may be used to allow the window regulator 10 to have an overall lower weight as also meeting a robust creep test requirement. Therefore, a window regulator 10 using the invention described herein and above will assist in allowing plastic/composite rail(s) 12 to be used in window regulators.

Figure 7:
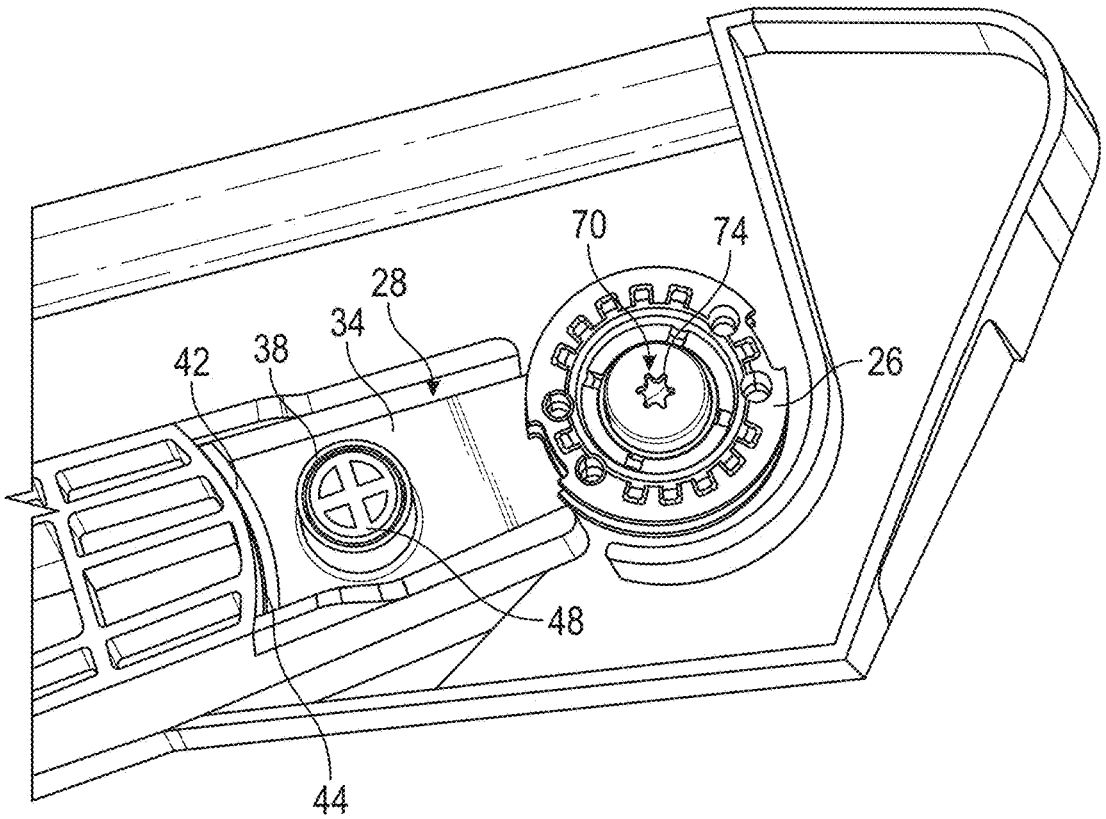
FIG. 7 a perspective view of yet another alternative embodiment of the present invention is illustrated.
Figure 8:
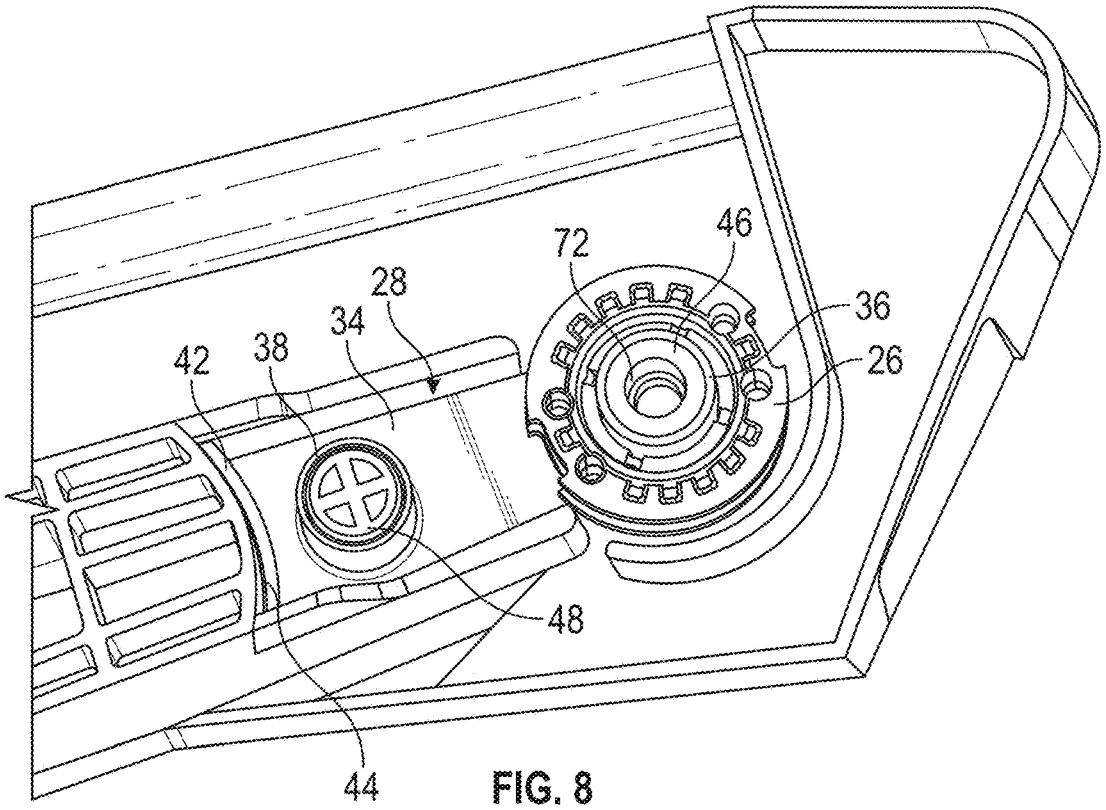
FIG. 8 a perspective view of the embodiment of FIG. 7 with the fastening means removed.

In yet another embodiment and as illustrated in FIGS. 7 and 8, the orientation of the bracket 28 with respect to guide rail 12 is reversed. Here pulley 26 is still rotatably received on collar 36 of the bracket 28 however, a fastener 70 (e.g., screw or any other equivalent means) is received within an opening 72 (threaded or otherwise) of boss 46 that is configured to have fastener 70 secured thereto. In addition, fastener 70 has a head portion 74 that is larger than the opening or inner opening 52 of pulley 26 in order to keep is rotatably secured to collar 36 when fastener 70 is secured to boss 46. Also, shown in FIGS. 7 and 8 is that opening 40 of bracket 28 and opening 54 of guide rail 12 and its supporting structure are removed from the embodiment of FIGS. 7 and 8. Of course and in yet another alternative embodiment, opening 40 of bracket 28 and opening 54 of guide rail 12 may be employed with the reverse orientation of bracket 28 illustrated in FIGS. 7 and 8.

As used herein, the terms "first," "second," and the like, herein do not denote any order, quantity, or importance, but rather are used to distinguish one element from another, and the terms "a" and "an" herein do not denote a limitation of quantity, but rather denote the presence of at least one of the referenced item. In addition, it is noted that the terms "bottom" and "top" are used herein, unless otherwise noted, merely for convenience of description, and are not limited to any one position or spatial orientation.

The modifier "about" used in connection with a quantity is inclusive of the stated value and has the meaning dictated by the context (e.g., includes the degree of error associated with measurement of the particular quantity).

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A bracket configured to support a pulley or a deflection ramp when the bracket is secured to a guide rail of a window regulator, the bracket comprising:

a main body portion;

a support integrally formed with the main body portion as a single piece, the support extending away from the main body portion and forming a pulley or ramp attachment, the support receiving a boss extending from a surface of the guide rail when the bracket is secured to the guide rail;

a flange for transferring loads applied to the pulley or the deflection ramp, wherein at least a portion of the main body portion is positioned on top of the pulley or the deflection ramp such that the pulley or the deflection ramp is located between the guide rail and the portion of the main body portion when the bracket is secured to the guide rail and the flange extends away from a longitudinal end of the main body portion; and a securement opening located in the main body portion, wherein the securement opening is located between the flange and the support such that a line passing through the securement opening generally perpendicular to the main body portion lies outside a perimeter of the pulley or the deflection ramp.

2. The bracket as in claim 1, wherein the bracket is formed from steel, aluminum or plastic.

3. The bracket as in claim 1, wherein the support is one of a pair of collars extending from the main body portion and wherein the securement opening is located between the pair of collars.

4. The bracket as in claim 3, wherein the guide rail is formed from plastic or plastic composite and the bracket is formed from steel, aluminum or plastic and wherein the boss extending from the surface of the guide rail is one of a pair of bosses configured to be received within the pair of collars when the bracket is secured to the guide rail.

5. The bracket as in claim 1, wherein the support is a first collar and the pulley is configured to receive the first collar, and wherein the bracket further comprises a second collar located between the flange and the first collar.

6. The bracket as in claim 1, wherein the flange has a curved surface configured to disperse an axial load to a curved surface of the guide rail that contacts the curved surface of the flange when the bracket is secured to the guide rail.

7. The bracket as in claim 1, wherein the guide rail is formed from plastic.

8. The bracket as in claim 1, wherein the pulley or the deflection ramp is an upper pulley or an upper deflection ramp.

9. A window regulator, having the bracket of claim 1, the window regulator comprising:

the guide rail;

the pulley or the deflection ramp for guiding a cable of the window regulator, wherein the bracket secures the pulley or the deflection ramp to the guide rail and wherein the loads are transferred by the flange to a portion of the guide rail remote from the pulley or the deflection ramp.

10. The window regulator as in claim 9, wherein the bracket is formed from steel, aluminum or plastic.

11. The window regulator as in claim 9, wherein the support is one of a pair of collars and the securement opening is located between the pair of collars.

12. The window regulator as in claim 11, wherein the guide rail is formed from plastic or a plastic composite and the bracket is formed from steel, aluminum or plastic and wherein the boss extending from the surface of the guide rail is one of a pair of bosses configured to be received within the pair of collars when the bracket is secured to the guide rail.

13. The window regulator as in claim 12, wherein the bracket is secured to the guide rail by a fastener that passes through the securement opening in the bracket.

14. The window regulator as in claim 9, wherein the support is a first collar and the pulley is configured to receive the first collar, and wherein the bracket further comprises a second collar located between the flange and the first collar.

15. The window regulator as in claim 9, wherein the flange has a generally flat surface configured to disperse an axial load to a generally flat surface of the guide rail that contacts the generally flat surface of the flange when the bracket is secured to the guide rail.

16. The window regulator as in claim 9, wherein the flange has a curved surface configured to disperse an axial load to a curved surface of the guide rail that contacts the curved surface of the flange when the bracket is secured to the guide rail.

17. The window regulator as in claim 9, wherein the guide rail is formed from plastic or a plastic composite.

18. A method of transferring axial loads of a pulley of a window regulator to a surface of a guide rail of the regulator, comprising:

rotatably securing the pulley to a collar of a bracket;

securing the bracket to the guide rail via a fastener, wherein the collar is located about a boss of the guide rail; and transferring the axial loads of the pulley to the guide rail via the collar and a flange of the bracket, and wherein the flange is secured to the collar via a main body portion of the bracket and a portion of the main body portion is located on top of a portion of the pulley such that the pulley is located between the guide rail and the portion of the main body portion, wherein the fastener passes through an opening in the main body portion, and the opening being located between the flange and the collar.

19. The method of claim 18, wherein the bracket is formed from steel, aluminum or plastic and the guide rail and the boss are formed from plastic or a plastic composite and wherein the flange has a surface aligned with a corresponding surface of the guide rail when the bracket is secured to the guide rail.

20. A bracket configured to support a pulley or a deflection ramp when the bracket is secured to a guide rail of a window regulator, the bracket comprising:

a main body portion;

a support integrally formed with the main body portion as a single piece, the support extending away from the main body portion and forming a pulley or ramp attachment, the support receiving a boss extending from a surface of the guide rail when the bracket is secured to the guide rail;

a flange for transferring loads applied to the support by the pulley or the deflection ramp, wherein at least a portion of the main body portion is positioned on top of the pulley or the deflection ramp such that the pulley or the deflection ramp is located between the guide rail and the portion of the main body portion when the bracket is secured to the guide rail and the flange extends away from a longitudinal end of the main body portion; and wherein the support is one of a pair of collars offset from each other and extending from the main body portion; and a securement opening located in the main body portion, wherein the securement opening is located between the flange and the support such that a line passing through the securement opening generally perpendicular to the main body portion lies outside a perimeter of the pulley or the deflection ramp.

* * * * *